US006551766B1

(12) United States Patent
Smith et al.

(10) Patent No.: US 6,551,766 B1
(45) Date of Patent: Apr. 22, 2003

(54) PROCESS FOR SCRATCH HEALING OF MOTION PICTURE FILMS

(75) Inventors: Thomas M. Smith, Spencerport, NY (US); Luba Kordovski, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/107,703

(22) Filed: Mar. 27, 2002

(51) Int. Cl.[7] ..... G03C 11/06; G03C 11/08

(52) U.S. Cl. ..... 430/432; 430/12; 430/531; 430/533; 430/934; 430/961; 430/494

(58) Field of Search ..... 430/12, 432, 531, 430/934, 961, 533, 494

(56) References Cited

U.S. PATENT DOCUMENTS

| | | | | |
|---|---|---|---|---|
| 3,019,131 | A | 1/1962 | Haas et al. | |
| 3,081,192 | A | 3/1963 | Idelson | |
| 3,097,106 | A | 7/1963 | Blout et al. | |
| 4,426,431 | A | 1/1984 | Harasta et al. | |
| 4,427,283 | A | 1/1984 | Gasper | |
| 4,606,976 | A | 8/1986 | Hensel et al. | |
| 5,037,871 | A | 8/1991 | Jones | |
| 5,266,455 | A | 11/1993 | Jones | |
| 5,401,541 | A | 3/1995 | Hodnett, III | |
| 5,633,049 | A | 5/1997 | Bilkadi et al. | |
| 5,679,505 | A | 10/1997 | Tingler et al. | 430/531 |
| 5,965,304 | A | 10/1999 | Yau et al. | 430/531 |
| 6,172,775 | B1 | 1/2001 | Wang et al. | 430/536 |
| 6,190,846 | B1 | 2/2001 | Majumdar et al. | 430/529 |
| 6,220,943 | B1 | 4/2001 | Wang et al. | 451/67 |
| 6,221,546 | B1 | 4/2001 | Yau et al. | 430/14 |
| 6,258,517 | B1 | 7/2001 | Qiao et al. | 430/452 |
| 6,268,101 | B1 | 7/2001 | Yacobucci et al. | 430/531 |
| 6,274,298 | B1 | 8/2001 | Nair et al. | 430/432 |
| 6,303,281 | B1 | 10/2001 | Wang et al. | 430/533 |

FOREIGN PATENT DOCUMENTS

| | | |
|---|---|---|
| EP | 078 559 B1 | 9/1986 |
| EP | 678 784 A1 | 10/1995 |

*Primary Examiner*—Richard L. Schilling
(74) *Attorney, Agent, or Firm*—Andrew J. Anderson

(57) ABSTRACT

A process is described for healing scratches on the base side of an imaged motion picture film element comprising a polymeric film base having one or more image layers on one side thereof, the process comprising applying an aqueous coating formulation comprised of an aqueous dispersion of a polyurethane to the scratched base side of the motion picture film element, and drying the applied coating formulation to form a polyurethane layer, wherein the polyurethane comprises an aliphatic polyurethane which has a Young's modulus at 100% elongation to break of less than 4000 psi and a Sward hardness value of at least 60. Scratch healing formulations employed in accordance with the invention provide coated layers with superior resistance to blocking, cleaning solvents, and abrasion, and which are more flexible, dry faster, and are more effective in hiding minor scratches than that disclosed in the prior art.

16 Claims, No Drawings

PROCESS FOR SCRATCH HEALING OF MOTION PICTURE FILMS

FIELD OF THE INVENTION

This invention relates to a method of improving the usefulness and integrity of motion picture films, especially intermediate film that is used in the production of motion picture print films. In particular, the invention relates to use of an aqueous film-forming polymer dispersion that is applied to the base side of a scratched motion picture film, which upon drying will minimize the appearance and impact of the scratch(s). Motion picture films treated in accordance with the invention can thus be salvaged for subsequent use.

BACKGROUND OF THE INVENTION

Motion picture photographic films used in producing a release print (the film projected in movie theaters) include camera origination film, intermediate film, and the release print film. Current practice for most color motion picture production involves the use of at least four photographic steps. The first step is the recording of the scene onto a camera negative photographic film. While the original negative (typically after editing) may be printed directly onto a negative working print film in a second step to produce a direct release print, most motion picture productions use an additional two intermediate steps. Typically, the original camera negative film is printed onto a negative working intermediate film, such as Eastman Color Intermediate Film, yielding a master positive. The master positive is subsequently printed again onto an intermediate film providing a duplicate negative. Finally, the duplicate negative is printed onto a print film forming the release print.

In practice, several duplicate negative copies are produced from the master positive, and each of the duplicate negatives may then be used to make hundreds of print film copies. This multistep process helps save the integrity of the valuable original camera negative film in preparing multiple release prints. In certain situations, usually involving special effects, intermediate film may be used an additional two or more times in preparing the final duplicate negatives to be used in printing the release prints. In this case, the first duplicate negative is used to print onto intermediate film to produce a second master positive, which is in turn used to produce a second duplicate negative. The second duplicate negative may be then used for printing the release prints.

Motion picture films typically comprise one or more light sensitive silver halide emulsion imaging layers coated on one side of a film base. The occurrence of scratches on the side of the film opposite to the imaging layers (i.e., the "back" side or "base" side of the film) is generally more common because greater effort is taken to avoid scratching the inherently softer imaging layer side in all steps of film handling, processing, printing, and/or projecting. The presence of such scratches on original or duplicate films which are being printed can result in images of the scratch marks themselves being reproduced on the printed film. The impact of such reproduced scratch mark images, as well as actual scratch marks which may be formed in a print film, on the projected print image is of course undesirable. Accordingly, once an intermediate film obtains too many scratches to produce acceptable prints therefrom, another intermediate film needs to be prepared. Considerable time and expense during production of print films can be eliminated if minor damage to the base side of an intermediate film can be "healed" rather than generating a new film. Additionally, if scratches formed on the base side of a print film, visible upon projection, can be minimized or eliminated by "healing", the quality and duration of use of a print film can also be improved.

The photographic film supports materials used in motion picture intermediate and print film elements typically are synthetic high molecular weight polymeric materials. These support materials may be comprised of various polymeric films, but polyester and triacetate film supports, which are well known in the art, are preferred.

One method of scratch healing which has been employed for older, acetate-based photographic films consisted of transporting the scratched film over a rotating glass wheel immersed in an organic solvent mixture containing esters, ketones, and/or chlorinated hydrocarbons. This solvent blend sufficiently softened the film support so that it could be effectively burnished by the glass wheel, thereby eliminating all but the most severe scratches. Problems with this approach include the use of toxic and flammable organic solvents plus the fact that the approach will not work with newer, less soluble polyester-based films. Although polyester film base is more resistant to scratches and abrasion than cellulose triacetate base films, scratches can still occur which could render an intermediate film useless or dramatically compromise the quality or life expectancy of a print film.

Other approaches of suppressing the impact of scratches on photographic film base have involved alterations to the method of projection. A scratch suppressing illumination system for photographic printing is described in U.S. Pat. No. 4,427,283. This approach, however, is a costly way to compensate for the efect rather than eliminate its presence.

There are numerous references for providing abrasion and scratch resistant protective overcoats for photographic elements, but they primarily rely on a thermal or radiation-cured, cross-linkable coating to be applied prior to extensive handling. Their purpose is primarily to prevent scratching rather than heal already scratched photographic film. These coatings generally tend to be expensive and in some cases employ flammable and toxic monomers and/or coating solvents. Applications utilizing such protective overcoats are described, e.g., in U.S. Pat. Nos. 3,019,131, 3,081,192, 3,097,106, 5,401,541, and 5,633,049. While such cross-linked overcoats provide effective scratch and abrasion resistance, their use requires special additional processing steps following application of the coating and the uneconomical position of treating all film, whether it is scratched or not.

Simpler, less toxic and non-flammable overcoating alternatives are described, e.g., in U.S. Pat. Nos. 5,266,455, 6,268,101, and 6,303,281. These aqueous coating formulations eliminate the issue of flammability and they are relatively non-toxic. However, they rely on either elevated temperature curing, or incorporation of matte particles to provide suitable scratch resistance. Again, they do not address the issue of rendering existing scratches invisible, but rather the prevention of scratches in the first place.

Motion picture films with polyester film supports have recently been introduced which employ a process-surviving antistat backing layer and a protective topcoat on the base side (non image layer side) of the film, where such layers are applied as part of the film manufacturing process. The primary functions of the protective overcoat or barrier layer are to prevent the antistatic layer from interacting with components of the processing solutions, and to provide abrasion resistance. Protective topcoats that may be applied over the antistatic layer can include essentially any known polymeric binder. Useful hydrophobic polymers that may be effectively employed in the protective topcoat include polyurethanes, polyesters, polyamides, polycarbonates, cellulose esters, acrylic polymers, styrenic polymers, and the like. U.S. Pat. No. 5,679,505, e.g., describes the use of aliphatic polyurethanes as preferred polymeric binders for use in motion picture film back side topcoats. While the use of such materials has improved the overall performance of the motion picture film elements, they do not address the problem of healing scratches which may nevertheless be formed after manufacture of the film elements.

European Patent 678,784 A1 is directed towards a method and device for the rejuvenating of a polyester film base, and describes coating and drying of an aqueous film-forming polymer dispersion onto the base side of a scratched polyester film. While various broad classes of polymers are mentioned, including polyurethanes, copolyesters containing recurring ester groups derived from alkylene diols and a mixture of aromatic dicarboxylic acids and an aromatic sulphodicarboxylic acid, whose sulpho group is in salt form, are described as the preferred rejuvenation, or scratch healing polymer. However, it has been found that the specifically described rejuvenation coating has several deficiencies including: blocking resistance, flexibility, solvent resistance, abrasion resistance, and drying time. Accordingly, it would be desirable to provide a rejuvenation process which did not have such deficiencies.

SUMMARY OF THE INVENTION

In accordance with the invention, a process is described for healing scratches on the base side of an imaged motion picture film element comprising a polymeric film base having one or more image layers on one side thereof, the process comprising applying an aqueous coating formulation comprised of an aqueous dispersion of a polyurethane to the scratched base side of the motion picture film element, and drying the applied coating formulation to form a polyurethane layer, wherein the polyurethane comprises an aliphatic polyurethane which has a Young's modulus at 100% elongation to break of less than 4000 psi and a Sward hardness value of at least 60. Scratch healing formulations employed in accordance with the invention provide coated layers with superior resistance to blocking, cleaning solvents, and abrasion, and which are more flexible, dry faster, and are more effective in hiding minor scratches than that disclosed in the prior art.

DETAILED DESCRIPTION OF THE INVENTION

This invention relates to a scratch healing or rejuvenation formulation that can easily be applied to photographic motion picture films after manufacture of such films. Films which may be treated in accordance with the invention comprise a polymeric film base and one or more image layers on one side thereof. While in most instances the image layers of a motion picture film will be exposed and developed silver halide photographic emulsion layers, the invention will be equally applicable to healing scratches on the base side of motion picture films having image layers formed by other, less conventional techniques, e.g., such as imbibition printing.

The process of the invention is particularly applicable to curing of scratches on the back side of motion picture intermediate and print film elements, where the use of a scratch healing layer in accordance with the invention prevents transfer of scratch images from an intermediate negative to a release print during the print film printing operation, or projection of scratches on a print film onto a screen during film viewing. Without treatment, intermediate films that contain scratches may transfer the image of these defects onto the print film during subsequent printing operations. Similarly, print film containing such scratches exhibit poor viewing quality when the print film image is projected onto a motion picture screen unless treated.

The photographic film supports materials used in the motion picture intermediate and print film elements which may be treated in accordance with this invention typically are synthetic high molecular weight polymeric materials. These support materials may be comprised of various polymeric films, but polyester and triacetate film supports, which are well known in the art, are preferred. While the invention may be used for films employing either such type of support, the invention is particularly suitable for the treatment of films employing polyester film supports, and in particular polyethylene terephthalate, as prior art scratch healing processes designed for use with motion picture films having acetate supports are typically not effective for polyesters.

Motion picture films employing polyester support members typically employ an antistat layer and a protective topcoat on the base side (non image side) of the film. The primary function of the protective overcoat or barrier layer is to prevent the antistatic layer from interacting with components of the processing solutions. Protective topcoats that may be applied over the antistatic layer can include essentially any known polymeric binder. Useful hydrophobic polymers that may be effectively employed in the protective topcoat include polyurethanes, polyesters, polyamides, polycarbonates, cellulose esters, acrylic polymers, styrenic polymers, and the like. Particularly preferred polymeric binders for use in the topcoat include aliphatic polyurethanes such as those described in U.S. Pat. No. 5,679,505, which is incorporated herein by reference.

Ideally, any layer subsequently applied over the protective topcoat which is coated during film manufacturing, such as a scratch healing formulation applied in accordance with the invention, should have physical properties at least as good as those of the protective topcoat layer. These properties include optical clarity with no induced color, adequate scratch and abrasion resistance, resistance to blocking in roll form and resistance to commonly employed cleaning solvents, plus an acceptable degree of curl, flexibility, and friction. In addition, it must form a uniform coated layer, dry in a reasonable time and possess adequate adhesion to the underlying layers.

Scratch healing formulations employed in accordance with the invention comprise an aqueous polyurethane dispersion, which is film forming at room temperature, the polyurethane having a combination of a relatively low Young's modulus measured at 100% elongation to break (i.e., less than 4000 psi) coupled with a high degree of hardness (i.e., Sward hardness value of at least 60, where Sward hardness value is a percentage hardness rating relative to plate glass). Aliphatic polyurethanes generally provide excellent thermal and LW stability and freedom from yellowing, properties which are desirable for use in the present invention, and aliphatic polyurethanes having the described combination of modulus and hardness produce a dried film having a superior combination of flexibility and abrasion resistance.

Preparation of aqueous polyurethane dispersions is well-known in the art, and typically involves chain extending an aqueous dispersion of a prepolymer containing terminal isocyanate groups by reaction with a diamine or diol. The prepolymer is prepared by reacting a polyester, polyether, polycarbonate, or polyaciylate having terminal hydroxyl groups with excess polyfunctional isocyanate. The resulting product is then treated with a compound that has functional groups that are reactive with an isocyanate, for example, hydroxyl groups, and a group that is capable of forming an anion, typically a carboxylic acid group. The anionic groups are then neutralized with a tertiary amine to form the aqueous prepolymer dispersion. It is an advantage of the invention that crosslinking is generally not required to provide good performance in the scratch healing coated layers. If desired, however, the polyurethanes may be crosslinked by addition of a crosslinking agent that reacts with functional groups present in the polyurethane, for example, carboxyl groups. Suitable crosslinking agents include aziridines, carbodiimides, epoxies, and the like.

In preferred embodiments, the polyurethane is selected so as to have an index of refraction closely matching that of the film support or backing, and a surface tension such that dilute aqueous dispersions can be easily coated on existing motion picture film backings without repellency or the need for additional coating aids. For optimized coating performance, the concentration of the polyurethane in the aqueous scratch healing coating formulation is preferably from 5 to 35 wt %, more preferably from 20 to 30 wt %, and the viscosity of the coating formulation is preferably from 10 to 800 cps, more preferably from 10 to 30 cps. For optimized scratch healing performance, the dried coverage of the applied polyurethane layer is preferably from 2000 to 7000 mg/m$^2$, more preferably from 3000 to 4000 mg/m$^2$. For optimized drying performance, the applied coating should be able to be dried to a tack-free condition in less than 100 seconds, particularly at drying temperatures of 40° C. or lower.

To optimize film handling performance after application of the scratch healing layer, the polyurethane coating applied in accordance with the invention is preferably resistant to blocking against the outermost layer on the image layer side of the motion picture film element when such applied coating and such outermost layer are in contact at temperatures up to 60° C. and relative humidity up to 80%, and the applied coating further preferably provides a coefficient of friction of from 0.10 to 0.40. While it is preferred that the polyurethane itself is selected to provide such properties alone, various additives such as lubricants and matting agents may be included in the coating formulation if desired to further enhance such properties.

Methods of cleaning motion picture films include total immersion in select organic solvents. The polyurethane of scratch healing formulations employed in accordance with the invention preferably are substantially insoluble in such cleaning solvents, or otherwise exhibit sufficient solvent resistance to prevent dissolution in the cleaning solvent bath or softening and either "gumming up" the transport rollers or blocking within the roll once the film is wound up after treatment, to allow the dried coating to be cleaned using any of such commonly employed motion picture film cleaning solvents without the need for cross-linking. Such cleaning solvents, which may be used in various parts of the world, include 1,1,1 trichloroethane, tetrachloroethylene, isopropyl alcohol, isobutyl benzene, and other hydrocarbon solvents. Until recently, the principle cleaning solvent used by the industry has been 1,1,1 trichloroethane (a.k.a. methyl chloroform). However, this compound has been identified as an "ozone depletor" and its use is being phased out. Tetrachloroethylene (a.k.a perchloroethylene), which is still used as a Wet-Gate printing solvent, has been used to clean film as well, but it is very slow to dry which necessitates reduction in speed of the cleaning equipment. Isopropyl alcohol is also being used as a film cleaning solvent. Its major drawback, to the industry, is a flashpoint of 12° C. Isobutyl benzene has been used to some extent as a film cleaning solvent, but it has a strong odor, poses a moderate fire risk, and is toxic in high concentrations. ACTREL 1064-L, manufactured by the Exxon Chemical Co. is a proprietary hydrocarbon solvent and, as such, has all the flammability concerns associated with that class of solvent although it is being used as a replacement for methyl chloroform.

The following examples are intended to illustrate the present invention more practically but not to limit it in scope in any way.

EXAMPLES

To evaluate the effectiveness of various scratch healing formulations, a color photographic film element was used comprising a polyethylene terephtbalate support base having on one (imaging layer) side thereof fine grain silver bromoiodide photographic emulsion layers (average emulsion grain sizes less than 0.30 micrometers) suitable for use in a color motion picture intermediate film and a gelatin-containing protective overcoat, and on the opposite (non-imaging layer) side thereof an antistat layer composed of a polythiophene conductive polymer overcoated with a polyurethane layer containing 5.75%, by weight, polyfunctional aziridine crosslinker, 3% polymethyl methacrylate matte beads, 0.7% surfactant, and 0.1% pentaerythrityl tetrastearate lubricant. The film was photographically processed, unexposed, which results in a minimum optical density and represents the worse case scenario for base-side scratches when printing or upon projection.

One-foot lengths of film were then intentionally scratched on the base (non-emulsion) side with a 3M SCOTCHBRITE cleaning pad using moderate pressure. This abrasion technique produces a multitude of scratches, very visible to the naked eye in reflected light, varying from almost non-existent to very severe. These test strips were coated over a portion of the scratched area with potential scratch healing formulations, to provide a side by side visual comparison of scratch hiding capability on each test strip.

Potential scratch healing formulations were prepared by diluting various commercial polyurethane P-1 to P-10 dispersions to a non-volatile content of 25% using distilled water. No additional surfactants or coating aids were added. A polyesterionomer P-11 dispersion (AQ 55 from Eastman Chemical Corp.) was prepared in the same manner and is typical of the rejuvenation formulation proposed in EP 0678 784. The polymer materials evaluated are:

P-1: Hybridure 580 (Air Products & Chemicals, Inc.)
P-2: Morthane CA-848-108 (Huntsman Corp.)
P-3: NeoRez R-600 (ICI Resins)
P-4: NeoRez R-960 (ICI Resins)
P-5: NeoRez R-9637 (ICI Resins)
P-6: NeoRez R-9649 (ICI resins)
P-7: NeoRez R-9679 (ICI Resins)
P-8: NeoRez R-972 (ICI Resins)
P-9: Sancure 898 (B.F.Goodrich Co.)
P-10: Witcobond 232 (Witco Corp.)
P-11: AQ 55 (Eastman Chemical Products, Inc.)

The formulations were coated over a portion of the scratched film using a #5 wire-wound coating rod, producing a dry coating coverage of approximately 3400 mg/m$^2$. The coated film was then dried in a forced-air oven for 15 minutes at a temperature of 50° C. The thickness of the scratch healing layer thus produced is approximately 3.2 micrometers.

The materials evaluated are listed in Table 1 along with evaluations with respect to coatability, dried surface hardness ("OK"=Sward hardness>5, not too soft to further evaluate, "Soft"=Sward hardness<5, too soft to further evaluate) and the degree of scratch healing ("Excellent"= greater than 80% of scratches healed; "Good"=50–80% of scratches healed; "Fair"=20–49% of scratches healed).

TABLE 1

| Material | Coatability | Hardness | Scratch Healing |
|---|---|---|---|
| P-1 | repellency | ~ | ~ |
| P-2 | ok | soft | ~ |
| P-3 | ok | soft | ~ |
| P-4 | ok | ok | fair |
| P-5 | ok | ok | excellent |
| P-6 | repellency | ~ | ~ |
| P-7 | ok | ok | excellent |
| P-8 | ok | ok | excellent |
| P-9 | ok | ok | excellent |
| P-10 | ok | ok | excellent |
| P-11 | ok | ok | good |

Several of the polyurethanes P-1 through P-10 evaluated provided noticeably better scratch healing than the polyesterionomer material P-11 coated as a reference for the prior art. All of the materials rated for scratch healing produced a clear, colorless coating having good flexibility and adhesion to the film backing, as measured by a tape adhesion test using #610 tape manufactured by the 3M Company.

As an evaluation of subsequent scratch and abrasion resistance, each of the polyurethane candidates P-5, P-7, P-8, P-9, and P-10 from the initial evaluation was coated on un-scratched polyester support along with polyesterionomer material P-11 at a dry coverage of approximately 4800 mg/m$^2$ and dried 15 minutes at a temperature of 50° C. These sample coatings were then tested using a Taber Abrader for 100 cycles with a 125 gram load. The abrasion resistance was quantified by measuring the haze of the coating before and after abrading. The results are reported as delta haze with lower values representative of more abrasion resistant coatings. The results of this test are shown in Table 2 below, along with manufacturer reported Young's modulus (100%) and Sward Hardness values for the polyurethanes.

Another desirable feature of any applied backing layer is that it have a coefficient of friction within a range of about 0.10 to 0.40. If the friction coefficient is much below 0.10, the risk of "telescoping" film rolls is much greater. However, if the friction coefficient is too high, it will not transport easily during printing and/or projection. The coefficient of friction was measured on each of the coatings produced above and the values are also listed in Table 2.

TABLE 2

| Material | 100% Young's Modulus (psi) | Sward Hardness | Taber Abrasion (delta haze) | Coefficient of Friction |
|---|---|---|---|---|
| P-5 | 7000 | 58 | 13.4 | 0.49 |
| P-7 | 3800 | 50 | 23.6 | 0.49 |
| P-8 | ~ | 6 | 16.8 | 0.11 |
| P-9 | 3000 | 62 | 10.0 | 0.38 |
| P-10 | 6000 | ~ | 11.5 | 0.60 |
| P-11 | ~ | ~ | 23.2 | 0.28 |

As indicated, the polyurethanes in most instances produced more brasion resistant coatings than the polyesterionomer. Two of the polyurethanes tested and the polyesterionomer provided desirable coefficients of friction between 0.10 and 0:40 and thus could be used "as is", while the other polyurethanes would likely require addition of some level of lubricant for use as a backing layer. Only polymer P-9 (SANCURE 898 from B.F. Goodrich) having Young's modulus and Sward Hardness values in accordance with the invention provided the best abrasion resistance in combination with a desirable coefficient of friction.

The resistance of scratch healing formulations to typically used cleaning solvents was also evaluated as follows. Coatings of each material were made on polyester support at a dry coverage of 4800 mg/m$^2$ and dried for 15 minutes at a temperature of 50° C. A few drops of each cleaning solvent were placed on the coating surface and left there for 30 seconds at room temperature. At that point, the solvent drop was wiped away using a paper towel and the test area was examined for any change in appearance, tackiness, dissolution, or loss of adhesion. The results are listed in Table 3, where "Good"=no apparent change in any property, "Fair"=slight softening observed, but coating in test area not completely rubbed away, and "Poor"=coating in test area dissolved or softened and rubbed away.

TABLE 3

| | Solvent Resistance | | | | |
|---|---|---|---|---|---|
| Coating | ACTREL 1064-L | Iso-propanol | Isobutyl Benzene | Tetrachloro-ethylene | Methyl Chloroform |
| P-5 | good | poor | good | good | good |
| P-7 | good | poor | good | fair | good |
| P-8 | good | poor | fair | fair | good |
| P-9 | good | good | good | good | good |
| P-10 | good | poor | good | good | good |
| P-11 | good | fair | fair | good | good |

The only material that had good resistance to all solvents tested is polyurethane P-9 (SANCURE 898 from B.F. Goodrich). For many polyurethanes, it is observed that performance in isopropanol is particularly challenged. Accordingly, in preferred embodiments of the invention, a polyurethane such as P-9 which is substantially insoluble in isopropanol at room temperature (i.e., 20 C.) is used in the scratch healing formulations employed in the invention.

Another preferred property of any applied scratch healing layer is that it be resistant to blocking in roll form under reasonable temperatures and humidity. Coatings that are too thermoplastic or too hydroscopic may adhere to the emulsion side of the film under extreme environmental conditions and subsequently destroy the emulsion layer when unwound. To evaluate this characteristic, coatings of polyurethane P-9 (SANCURE 898) and polyesterionomer P-11 (AQ 55) were made on the base side of photographic elements similarly as described above at a dry coverage of 3200 mg/m$^2$ and dried for 15 minutes at a temperature of 50° C. These coatings were then conditioned at various environments for 24 hours. After this equilibrium period, the coatings were placed in contact with the emulsion side of the film and incubated for 24 hours at the same environmental conditions. A load of approximately 38 g/cm$^2$ was applied to the samples. A set of uncoated control films (emulsion to backside) were included as a comparison at each environmental condition. After incubation, the samples were separated and rated for blocking resistance. The results are shown in Table 4, where "None"=no resistance to separation and no damage upon separation, "Very Slight"=slight adhesion but no damage upon separation; "Slight"=moderate adhesion and slight damage upon separation; and "Severe"= total adhesion and extensive damage upon separation.

TABLE 4

| Environmental Condition | Blocking | | |
|---|---|---|---|
| | Uncoated Film | P-9 | P-11 |
| 23 C./80% RH | none | none | none |
| 32 C./90% RH | slight | slight | severe |
| 50 C./50% RH | none | none | very slight |
| 60 C./50% RH | very slight | none | severe |

As indicated, an applied layer of polyurethane P-9 (SANCURE 898) is no worse than the uncoated, untreated film itself. However, an applied layer of polyesterionomer P-11 (AQ 55) will potentially block at elevated, but not unrealistic, temperature or humidity.

An additional requirement of any post-applied backing layer is that it dries relatively quickly. To evaluate this property, both the polyesterionomer P-11 (AQ 55) and polyurethane P-9 (SANCURE 898) were coated from 25% solids dispersions onto polyester support. Both materials were coated at wet coverages of 8 micrometers and 24 micrometers. The thinner wet coating will dry down to an equivalent coverage of 8600 mg/m$^2$ and the thicker wet coating will dry down to an ultimate coverage of 25,800 mg/m$^2$. The tack-free time, as judged by touching the coating surface with a fingertip, was measured at drying temperatures of 22, 38 and 60° C. in a forced-air oven. The results are shown in Table 5.

TABLE 5

| Coating | Tack-free Time (sec) | | |
|---|---|---|---|
| | @ 22 C. | @ 38 C. | @ 60 C. |
| P-9 ($\mu$m wet) | 75 | 20 | 15 |
| P-11 (8 $\mu$m wet) | 90 | 30 | 25 |
| P-9 (24 $\mu$m wet) | 270 | 35 | 25 |
| P11 (24 $\mu$m wet) | 300 | 43 | 30 |

The polyurethane P-9 exhibits a slightly faster rate of drying than the olyesterionomer P-11 at the same wet coating coverage. Although the difference is slight, this is an advantageous characteristic.

To evaluate the ability to hide scratches on commercial motion picture films, Eastman Kodak color intermediate film ECI 2244 and Fuji color intermediate film 4502 were scratched and coated according to the methods previously described. Both of these films comprise polyester-based (polyethylene terephthalate) supports. ECI 2244 has a carbon-black containing backing layer that is removed during film processing, leaving a bare polyester back side surface. Each film was processed, unexposed, resulting in a minimum optical density and representingthe worse case scenario for base-side scratch printing or projection.

Polyurethane P-9, diluted to a non-volatile concentration of 25% was coated over a portion of the abraded films at a dry coverage of 3400 mg/m$^2$ and dried for 15 minutes in a forced-air oven at a temperature of 50° C. The level of scratch healing on these two films was judged to be good to excellent. As with the previously tested film, the coatability, adhesion, clarity, and flexibility of the applied layer are excellent.

The invention has been described in detail with particular reference to certain preferred embodiments thereof, but it will be understood that variations and modifications can be effected within the spirit and scope of the invention.

What is claimed is:

1. A process for healing scratches on the base side of an imaged motion picture film element comprising a polymeric film base having one or more image layers on one side thereof, the process comprising applying an aqueous coating formulation comprised of an aqueous dispersion of a polyurethane to the scratched base side of the motion picture film element, and drying the applied coating formulation to form a polyurethane layer, wherein the polyurethane comprises an aliphatic polyurethane which has a Young's modulus at 100% elongation to break of less than 4000 psi and a Sward hardness value of at least 60.

2. A process according to claim 1, wherein the motion picture film element comprises a polyethylene terephthalate support.

3. A process according to claim 2, wherein the motion picture film element is a motion picture intermediate film.

4. A process according to claim 3, wherein the motion picture intermediate film is a motion picture duplicate negative, and further comprising the subsequent step of using the polyurethane layer coated duplicate negative to print a positive motion picture release print, whereby images of scratches healed in the intermediate film by the polyurethane layer are thus not transferred to the release print.

5. A process according to claim 2, wherein the motion picture film element is a motion picture release print film.

6. A process according to claim 5, and further comprising the subsequent step of projecting the release print film image on a motion picture screen, whereby scratches healed in the release print film are thus not visible in the projected film image.

7. A process according to claim 2, wherein the concentration of the polyurethane in the aqueous coating formulation is from 5 to 35 wt % and the viscosity of the coating formulation is from 10 to 800 cps.

8. A process according to claim 7, wherein the polyurethane concentration is from 20 to 30 wt % and the viscosity is from 10 to 30 cps.

9. A process according to claim 2, wherein the dried coverage of the applied polyurethane layer is from 2000 to 7000 mg/m$^2$.

10. A process according to claim 9, wherein the dried coverage is between 3000 to 4000 mg/m$^2$.

11. A process according to claim 1, wherein the applied coating is dried to a tack-free condition in less than 100 seconds.

12. A process according to claim 11, wherein the drying temperature is 40° C. or lower.

13. A process according to claim 1, wherein the applied coating is resistant to isopropyl alcohol, isobutyl benzene, tetrachloroethylene, and 1,1,1 trichloroethane film cleaning solvents without the need for cross-linking.

14. A process according to claim 1, wherein the polyurethane is substantially insoluble in isopropyl alcohol at 20 C.

15. A process according to claim 1, wherein the applied coating is resistant to blocking against the outermost layer on the image layer side of the motion picture film element when such applied coating and such outermost layer are in contact at temperatures up to 60° C. and relative humidity up to 80%.

16. A process according to claim 1, wherein the applied coating provides a coefficient of friction of from 0.10 to 0.40.

* * * * *